US006242093B1

(12) United States Patent
Ferguson

(10) Patent No.: US 6,242,093 B1
(45) Date of Patent: Jun. 5, 2001

(54) CARBON FIBERS

(75) Inventor: James Ferguson, Glasgow (GB)

(73) Assignee: The Secretary of State for Defense in Her Britannic Majesty's Government of the United Kingdom of Great Britain and Northern Ireland, Farnborough (GB)

( * ) Notice: Subject to any disclaimer, the term of this patent is extended or adjusted under 35 U.S.C. 154(b) by 3 days.

(21) Appl. No.: 09/624,138

(22) Filed: Jul. 21, 2000

Related U.S. Application Data

(62) Division of application No. 09/029,999, filed as application No. PCT/GB96/02248 on Sep. 12, 1996.

(30) Foreign Application Priority Data

Sep. 14, 1995 (GB) ..... 9518798

(51) Int. Cl.[7] ..... D01F 6/00; D01F 9/12; D01F 9/00

(52) U.S. Cl. ..... 428/367; 428/398

(58) Field of Search ..... 428/364, 394, 428/398, 367; 423/447.1

(56) References Cited

U.S. PATENT DOCUMENTS

| | | | |
|---|---|---|---|
| 3,180,845 | 4/1965 | Knudsen et al. . | |
| 4,051,300 | 9/1977 | Klein et al. . | |
| 4,385,017 | 5/1983 | Joh et al. . | |
| 4,493,629 | 1/1985 | Goffe . | |
| 4,728,431 | 3/1988 | Nagura et al. . | |
| 4,882,223 | 11/1989 | Aptel et al. . | |
| 4,908,235 | 3/1990 | Smolders et al. . | |
| 5,554,292 | 9/1996 | Maeda et al. . | |
| 5,656,372 | 8/1997 | Gentile et al. . | |
| 6,143,411 * | 11/2000 | Ferguson | 428/398 |

FOREIGN PATENT DOCUMENTS 0 294 737 12/1988 (EP) .

OTHER PUBLICATIONS

Patent Abstracts of Japan vol. 11, No. 167 (C–425) May 1987 & JP A61 296115 (Asahi Medical KK) 26 see abstract.

* cited by examiner

*Primary Examiner*—N. Edwards
(74) *Attorney, Agent, or Firm*—Nixon & Vanderhye

(57) ABSTRACT

The invention is directed to a solid walled hollow carbon fiber made from a hollow polyacrylonitrile fiber.

6 Claims, 4 Drawing Sheets

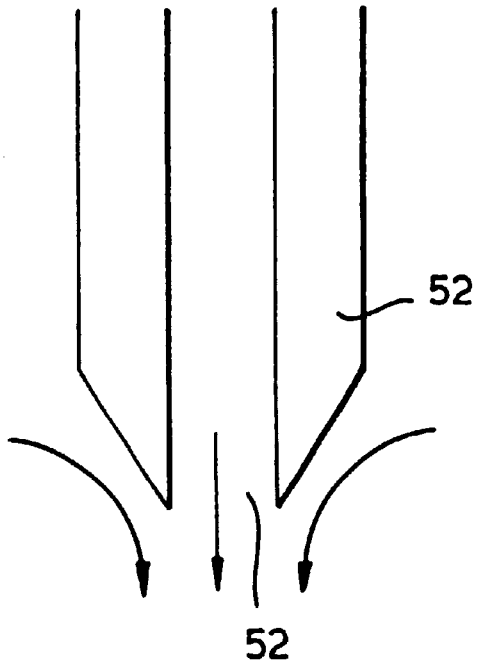
Fig.5.
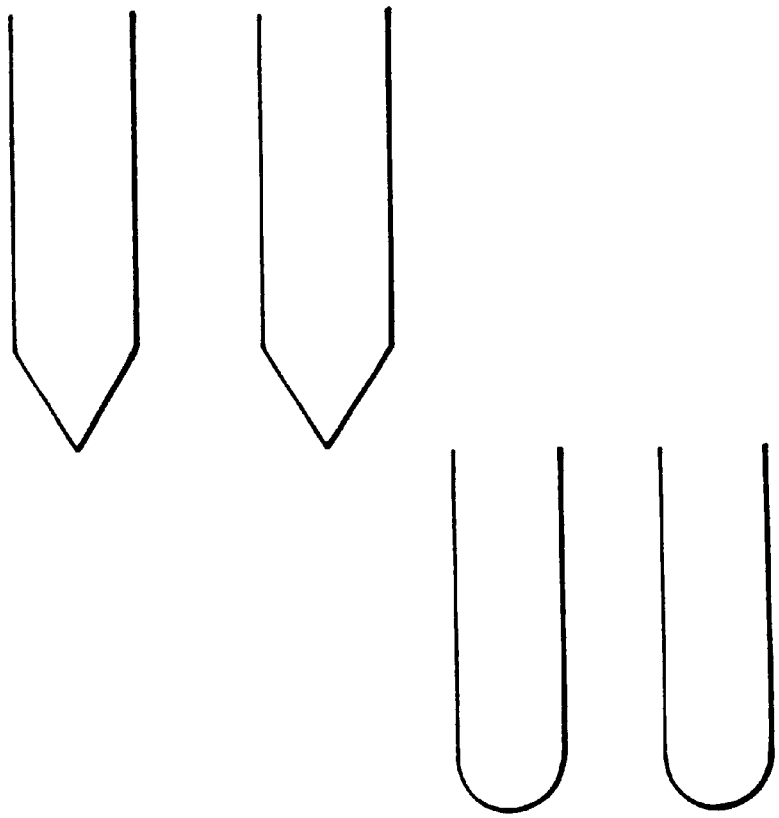

CARBON FIBERS

This is a 35 U.S.C. §371 of PCT/GB96/02248 filed Sep. 12, 1996.

The invention relates to methods of manufacture of hollow polymeric fibres by wet spinning, to a multi-hole spinneret for use in such manufacture, and to a method of production of hollow carbon fibre from hollow polymeric fibre, specifically polyacrylonitrile.

BACKGROUND OF THE INVENTION

Spinning has been defined as the transformation of a liquid material into a solid fibre. There are three main methods for spinning fibres: melt spinning, dry spinning and wet spinning. These methods can be combined depending on the final properties required of the material (such as a polymer) being spun.

Melt spinning is preferred if the polymer can be melted without degradation and is a common method for spinning thermoplastics such as polypropylene and nylon. The molten polymer is extruded through a spinneret into a gaseous medium such as air where the fibre cools producing solid, non-porous fibre. The filament is usually then drawn to orientate the polymer molecules which also improves the tensile properties of the fibre.

Dry spinning involves the extrusion of a polymer dope (polymer dissolved in an appropriate solvent) into a heated zone where the solvent evaporates. This is a slower process than the cooling of melt spun fibres and, as a result tends to produce fibres with non-uniform properties and a less circular cross section.

Wet spinning is identical to dry spinning except in the way the solvent is removed from the extruded filaments. Instead of evaporating the solvent, the fibre is spun into a liquid bath containing a solvent/non-solvent mixture called the coagulant. The solvent is nearly always the same as that used in the dope and the non-solvent is usually water.

Dry and wet spinning can be combined to form a process known as dry jet wet spinning. Polymer dissolved in a suitable solvent is extruded into a gap before entering a coagulation bath containing a coagulant that is miscible with the solvent but not with the polymer. A phase inversion process takes place producing a solid fibre. The bath can contain a mixture of solvent and non-solvent. This method helps prevent blockage of the spinneret and also allows some drawing of the fibre prior to coagulation, increasing orientation of the polymer molecules. The air gap has been shown to produce fibres that are stronger and more extensible than fibres produced from an immersed jet.

The fibre microstructure is established in the coagulation bath and requires optimisation of conditions. The critical process is the transition from a liquid to a solid phase within the fibrils and there are two possible such transitions. One is phase inversion—the precipitation of polymer to form a solid phase, the other is gelation. The former yields fibre of poor mechanical properties where as the latter produces an elastic gel giving rise to a fine microstructure once the solvent is removed. For membrane-type fibres phase inversion is preferable. For fibres with the appearance of a solid wall phase inversion should be slowed down so that gelation precedes phase inversion. Conditions in the coagulation bath have, therefore, to be optimised so that gelation precedes phase inversion. It has been shown that gelation occurs more rapidly at lower temperatures and at higher solid concentration in the dope.

The concentration of solvent in the coagulation bath can also be adjusted to obtain the desired microstructure. A low solvent concentration promotes rapid solvent extraction although this results in a thick skin on each filament which ultimately reduces the rate of solvent extraction and can lead to the formation of macrovoids. A high concentration of solvent in the coagulant gives a denser microstructure but solvent extraction is low. Temperature of the coagulation bath, jet stretch and immersion bath can similarly affect coagulation and microstructure. The fibre produced is essentially a swollen gel and is unoriented. The microstructure consists of a fibrilar network with the spaces in-between called macrovoids.

The invention is directed towards an improved spinning method of dry-jet wet spinning which enables the production of hollow polymeric fibres with the hole or lumen accurately centred and permits an enhanced degree of control over the wall properties. Consistent wall properties are likely to be of great significance in a range of applications: for example the best combination of tensile properties is achieved when the fibre has a homogeneous, dense gel structure with small fibrils and no macrovoids; for application as a membrane the wall ideally has a highly oriented inner and outer skin separating a porous body. The invention is also directed towards a suitable spinning apparatus; in particular one which is suitable for the production of polyacrylonitrile fibres suitable for subsequent processing to produce hollow carbon fibres.

According to an aspect of the invention a method of manufacture of hollow polymeric fibres comprises the steps of:

i) dissolving polymer in a suitable solvent to form a dope;

ii) extruding the dope through an aperture in a spinneret to form a jet of liquid;

iii) injecting a first coagulant into the centre of the dope jet as it leaves the spinneret;

iv) directing the jet through an air gap into a coagulant bath containing a second coagulant such that a fibre is formed;

v) directing the fibre through a drawing bath to reduce the diameter;

wherein each coagulant comprises a mixture of a coagulant liquid capable of causing gelation and eventual solidification of the dope jet and between 20% and 80% of the solvent liquid.

The invention produces hollow fibres whilst allowing a high degree of control over the spinning conditions and thus over the structure of the fibre wall. In particular for fibres with the appearance of a solid wall phase inversion should be slowed down so that gelation precedes phase inversion. The hollow fibres thereby produced offer comparable tensile properties at reduced weight in comparison to solid fibres produced by conventional wet spinning, offering advantages in a range of applications such as in the production of hollow fibres for textiles. It will be understood that the invention is not limited to production of single fibres but can produce multiple fibre arrays from multiple liquid jets either by providing a spinneret with multiple apertures or by providing an array of spinnerets.

Carbon fibres are manufactured by pyrolysing organic precursor fibres, predominantly polyacrylonitile (PAN) fibres produced by wet spinning. It may be noted here that the polyacrylonitrile fibre is used in this art to include co-polymers or ter-polymers of acrylonitrile with other monomers. For precursors of carbon fibre this is typically a copolymer with itaconic acid which controls the cylcisation reaction during pyrolysis. The requirement that gaseous products must be able to diffuse through the fibres from the surface to the centre, and vice-versa during the oxidation and carbonisation processes, imposes an upper diameter limit and the technique is limited to the production of carbon fibres for structural applications with diameters up to about 10 μm.

In the last decade, the tensile strength of these fibres has been doubled, leading to large increases in all tensile-related composite properties. However, under compressive loading the failure process is micro-buckling. Compressive strength is therefore strongly influenced by the diameter limit set by the manufacturing process and has remained largely unchanged over this period. As a result this property is often the key design parameter in strength critical applications. Hollow carbon fibres offer a possible solution as they offer the potential for increased second moment of area and hence resistance to buckling without exceeding thickness limits. This would require production of hollow precursor fibres of an appropriate size, and with a dense walled structure without macrovoids.

The invention is thus particularly applicable to the production of acrylic fibres such as polyacrylonitrile to serve as hollow carbon fibre precursors. Polyacrylonitrile of molecular weight in the range 80,000 to 200,000, typically about 120,000 is preferred, and is dissolved in an appropriate aprotic solvent, of which dimethyl formamide (DMF) and sodium thiocyanate are non-limiting examples. The dope formed preferably contains between 15% and 30% by weight, and typically 25%, by weight of polyacrylonitrile in the appropriate solvent. A preferred coagulant is water. The polymer concentration in the dope solution is preferably in the range 15–25%. The solvent concentration in the coagulant solution is preferably in the range 30–60%.

There is also the potential to incorporate a third phase into the hollow fibre core after formation which could find application in the smart materials field. For example, uncured resin could provide in-situ repair capability after fibre fracture or suspensions of fine powders could act as radar absorbers for stealthy capability.

Hollow carbon fibres suitable for applications where conventional carbon fibres are used at present will have diameters in the preferred range 20–40 μm, corresponding to polyacrylonitrile precursor fibre diameter of around 30–65 μm, with a wall thickness of 5–10 μm. Diameters of hollow carbon fibre in the region of 25 μm from polyacrylonitrile fibres of diameters in the region of 40 μm are particularly preferred. Fibre diameters are controllable through the aforementioned spinning variables. The process preferably requires stretching in a heated zone to reduce the spun fibre to the required diameter. The drawing bath conveniently contains heated liquid to facilitate this. Embrittlement that may ensue due to orientation effects and can adversely effect production of carbon fibre can be eliminated by relaxation at raised temperatures.

The conversion of the hollow PAN precursor to a hollow carbon fibre is achieved via the pyrolysing process which is used for solid carbon fibres and which will be familiar to those skilled in the art.

Another aspect of the invention provides a spinneret for manufacture of hollow polymeric fibres, and in particular hollow polyacrylonitrile precursors for carbon fibres, comprising a hollow body, a first inlet for a dope, a second inlet for a coagulant. A base plate having at least one extrusion aperture for extrusion of the dope, and coagulant injection means to inject a coagulant into extruded dope solution alignable to the centre of the or each extrusion aperture and in communication with the second inlet, such that in use a stream of dope is extruded through the or each aperture having a stream of coagulant at its centre. Each injection means conveniently takes the form of a hollow needle in communication with the second inlet and provided with an aperture at one end which can be aligned with the centre of an associated extrusion aperture.

To control the flow parameters, the injection means is preferably provided with vertical microadjustment means to control the distance between it and the extrusion aperture. Lateral microadjustment means to ensure accurate centring of the injection means over the extrusion aperture are also preferred.

At its simplest, this aspect of the invention comprises a single extrusion aperture and a single injection means. In the alternative, the base plate is provided with a number of extrusion apertures and the spinneret further comprises a number of injection means alignable to the centre of the extrusion apertures to enable multiple fibre spinning from a single spinneret. In a preferred arrangement, the spinneret has a hollow body cavity divided by an upper plate incorporating the injection means into an upper portion communicating with the first inlet and a lower portion communicating with the second inlet. The upper plate is preferably provided with a number of hollow needle-like depressions protruding towards the base plate and alignable to the centre of the extrusion apertures.

BRIEF DESCRIPTION OF THE DRAWINGS

The invention will now be described by way of example only with reference to the polyacrylonitrile/dimethyl formamide (DMF)/water system and to FIGS. 1–10 in which:

FIG. 5 is a cross-section of extrusion aperture profiles for injection of coagulant

DETAILED DESCRIPTION OF THE INVENTION

Polyacrylonitrile of molecular weight in the range 80,000 to 200,000, typically about 120,000 is dissolved in dimethyl formamide (DMF). The dope formed contains approximately 25%, by weight, of polyacrylonitrile in the solvent. This percentage is attained by rotary evaporation from a lower concentration. In the particular system polyacrylonitrile/DMF/water, a minimum grade of purity of the DMF is required—this is specified as technical grade of minimum assay (GLC) of 99%. The resultant dope will be moderately viscoelastic with a zero shear viscosity in the range 50–300 Pa.s at 20° C., and typically about 120 Pa.s. It is also possible for the viscosity of the spinning dope to be reduced by heating.

Figure 1:
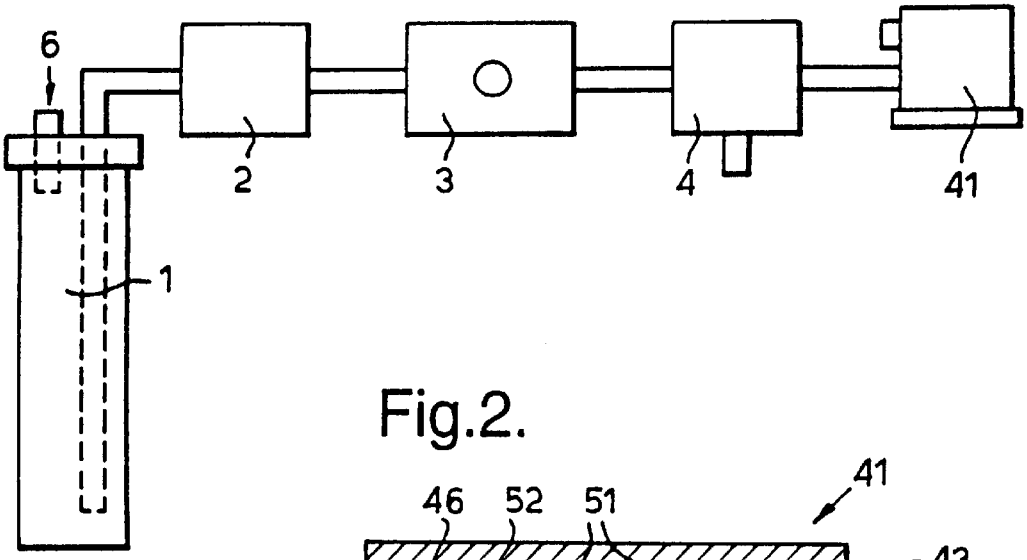
FIG. 1 is a schematic of the filtering and pumping stage

The dope is then filtered to ensure that flow through the spinneret remains unrestricted, FIG. 1. This is typically achieved by forcing it under nitrogen pressure (through nitrogen feed 6) of typically 6 bar through an on-line filter, 2, in which a 40 μm stainless steel mesh strainer is typically used. The dope is then pumped via a pump 3 through a second on-line filter 4, in which a 5 to 20 μm sintered stainless steel filter is typically used, and is then passed to the spinneret 41.

Figure 2:
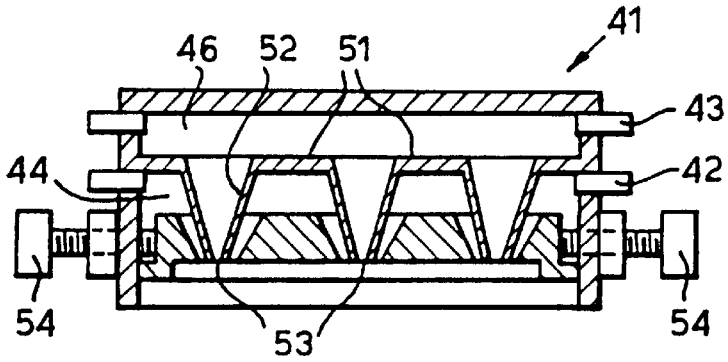
FIG. 2 is an axial cross-section of a multiple spinneret for use in spinning multiple continuous hollow fibres in accordance with the invention
Figure 3:
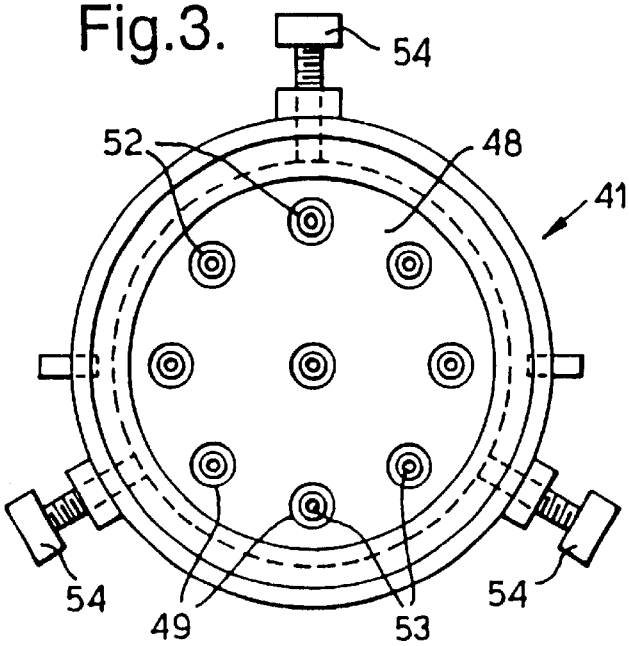
FIG. 3 is a plan view from below of the spinneret of FIG. 2
Figure 4:
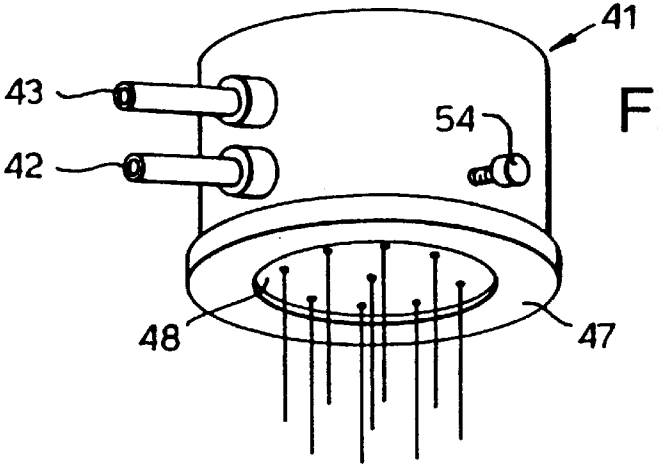
FIG. 4 is a perspective of the spinneret of FIG. 2

A spinneret arrangement is illustrated in FIGS. 2 to 4. The dope and coagulating liquid are injected into the spinneret, 41, at separately controllable rates via one or more inlet pipes 42 and 43 respectively. The dope passes into a lower body cavity 44 of the spinneret and the coagulant liquid is channelled through an upper body cavity 46. The cavities 44 and 46 are separated by an upper plate 51 which is provided with a plurality of downwardly extending extrusions 52 each ending in an aperture 53 which communicates with the upper body cavity 46 and through which a jet of coagulant is extruded into the dope jet. The protrusions 52 thus provide injection means for the coagulant. Alignment of base plate 48 to the protrusions 52 is then performed so that each aperture 49 serves as an outer annulus 50 which communicates with the lower body cavity 44 and through which the dope jet is extruded, with coagulant extruded through the inner aperture 53. This can be achieved optically through the use of a laser beam and the base plate thence mechanically fixed, or, for example, through the use of the well-known mechanism of centring screws 54.

Typical dimensions to enable production of fibres for structural purposes are from 220 μm to 600 μm (inner diameter) of aperture 53, 100 to 300 μm outer diameter of the protrusions 52, and inner diameter 50–200 μm. It will be appreciated however that the invention is not limited to this area and is applicable to production of hollow fibres for utilisation in other areas, in which case dimensions may be changed, for example, an inner diameter of aperture 53 of 1 mm would be typical for membranes. Examples of injection profiles are illustrated in FIG. 5.

Figure 6:
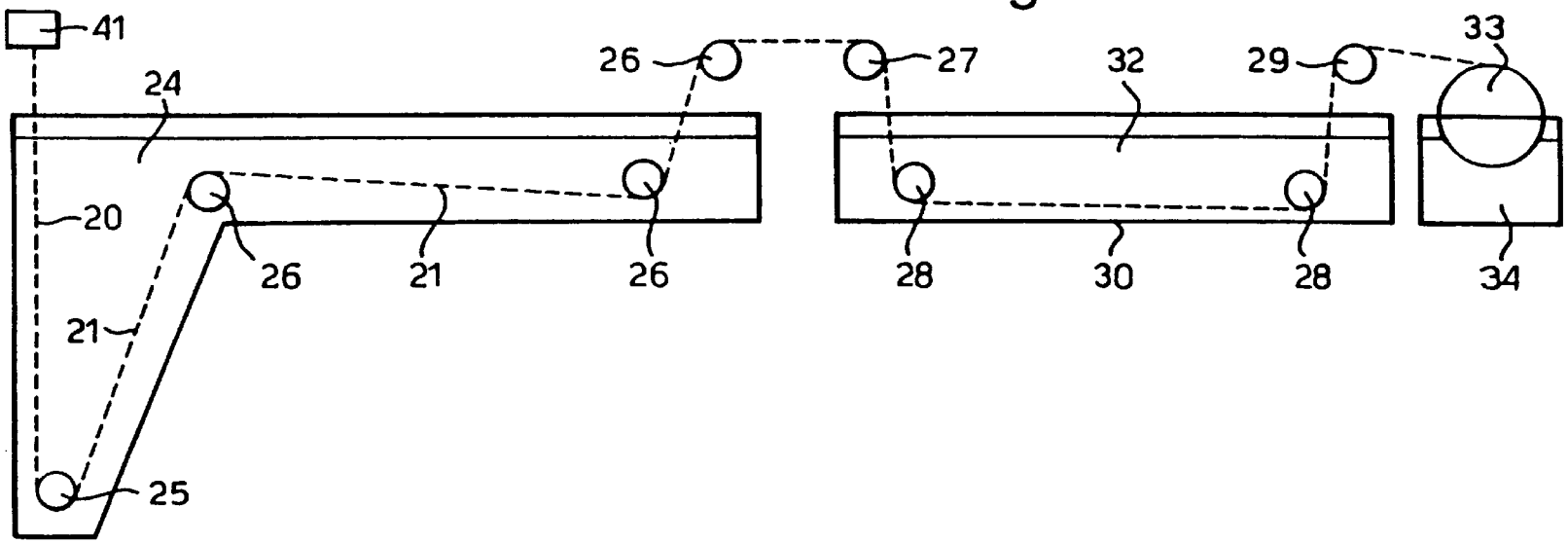
FIG. 6 is a schematic of the hollow fibre coagulation and stretching apparatus

As FIG. 6 illustrates, the resulting stream of dope and coagulant 20 is passed from the spinneret 41 through an air gap into a coagulating bath 22. The air gap (from spinneret to surface of the bath) is preferably between 8 and 30 cm, but ideally from 10–15 cm. Beyond 30 cm the stream of dope is unstable and unsuitable for processing.

Different structures can be obtained by control of the temperature of the coagulating bath and through variation of the proportion of coagulant to solvent. To produce fibres with the appearance of solid walls, coagulation must be slowed down whilst keeping diffusion rates high. This is ensured by the addition of solvent to conventional coagulants to such a level as to form a coagulant solution under the action of which the formation of the outer skin is slowed down compared with conventional coagulant liquids alone. Practical levels of solvent addition in the coagulant solution are in the range 20–80%, preferably in the region 30–60%. For example, for the system polyacrylonitrile/DMF/water the coagulation bath contains a solution 24 comprising 1:1 by weight of water:DMF cooled to between 4° C. and 9° C., but typically 8° C.±1° C. To prevent the fibre flattening as it passes around the rollers and to maintain a circular cross-section, it has to be allowed to sufficiently solidify to impart a degree of rigidity. This is achieved by passing it round a lead guide 25, of diameter not less than 4 cm diameter, at least 0.5 cm and a maximum of 1.5 m below the surface of the coagulation bath. The guide has a mechanism for raising and lowering it into the coagulation bath.

The fibre 21 is then directed via further guide rollers 26 which may, or may not, be driven, onto a motor driven guide roller 27. Variation of the drive rate of the roller 27 can be used to vary the speed at which the fibre 21 is drawn through the coagulating bath to control the jet stretch and orientate the fibre.

A bank of filter units is fitted along the coagulation bath to provide laminar air flow for withdrawal of potentially hazardous fumes, for example when using DMF. To reduce impurities within the fibres clean room conditions should be utilised. Such impurities are known to have a deleterious effect on resultant carbon fibre properties and the use of an anteroom for entrance to the spinning environment and air filtration has been demonstrated to reduce such effects.

The fibre 21 is then passed into a heated zone between 95°–100° C. to reduce diameter and to impart a degree of orientation. This may typically be a bath, 30, of water, 32, heated to near boiling point. The fibre passes via further guide rollers 28 onto a further driven roller 29. As before, variation of the drive rate of the driven roller 29 can be used to effect stretching of the fibre thereby, reducing the diameter. The rollers 28 are provided with a mechanism to be raised out of and lowered into the water 32. The fibre is then passed to a collecting drum in a washing bath 34. Subsequent washing may be dynamic or static for a minimum of 48 hours, though this is less critical if the fibre is to be pyrolysed.

The conditions under which the fibres are spun have influence on their final properties. Fibre diameter is ultimately controlled by the size of the aperture 53 through which they are extruded but post extrusion stretching, or drawing, of the fibres can also affect the final dimensions. The amount of post extrusion stretching also effects the tensile properties of the fibre.

As a measure of the amount of stretching that a fibre has received during its extrusion, the dimensionless term "Jet Stretch" (JS) is normally used and is defined as:

$$JS=A_{SP}V_f/DER$$

where $V_f$ is the fibre velocity (mm $s^{-1}$) on the first take-up roller, $A_{SP}$ is the annulus area of the spinneret ($mm^2$) and DER is the Dope Extrusion Rate ($mm^3$ $s^{-1}$) from the spinneret.

The amount of stretching that a fibre receives in the heated stage is the ratio of the fibre velocity on the roller at the start of the heated stage ($V_{fstart}$) to the fibre velocity on the roller at the end of the heated stage ($V_{fend}$) and is given the term "Draw Ratio" (DR):

$$DR=V_{fend}/V_{fstart}$$

With known values of the velocities of the rollers, the diameters of the orifice plate and the needle diameter, the dope extrusion rate and the perfusor rate, it is possible to estimate the diameter of the fibre and the diameter of the lumen on the final roller. A typical example is shown in Table 1. An example of different jet stretches and influence on tensile properties is given in Table 2.

TABLE 1

Determination of approximate fibre dimensions

| Parameter | Symbol/formula | Typical value |
|---|---|---|
| Perfusor rate | PR | 50 μl $min^{-1}$ |
| Orifice diameter | ORI | 600 μm |
| Needle outer diameter | NOD | 305 μm |
| Annulus area | $Ann = \pi (ORI^2 - NOD^2)/4$ | $2.1 \times 10^{-5} m^2$ |
| Fibre velocity (first roller) | VF | 130 mm $s^{-1}$ |
| Fibre velocity (last roller) | VL | 380 mm $s^{-1}$ |
| Dope concentration | DC | 25% |

TABLE 1-continued

Determination of approximate fibre dimensions

| Parameter | Symbol/formula | Typical value |
|---|---|---|
| Dope extrusion rate | DER | 4.5 $mm^3s^{-1}$ |
| Jet stretch | JS = VF.Ann/DER | 1.71 |
| Draw ratio | DR = VL/VF | 2.92 |
| Jet-Draw function | JR = JS.DR | 4.99 |
| Fibre diameter | $r_1$ = (4.(PR + DC.DER)/ π.DR.VF) | 81.0 μm |
| Lumen diameter | $r_2$ = (4.PR/π.DR.VF) | 52.9 μm |

TABLE 2

Examples of effect of chaniging the draw ratio

| draw ratio | fibre outer diameter (μm) | fibre inner diameter (μm) | Modulus (N/Tex) | strain at break (%) | Energy to break (mJ) | Tenacity at break (N/Tex) |
|---|---|---|---|---|---|---|
| 3.23 | 60 | 47 | 5.08 | 18.44 | 4.27 | 0.172 |
| 3.91 | 66 | 51 | 6.46 | 14.86 | 3.29 | 0.236 |
| 4.91 | 63 | 43 | 7.53 | 13.24 | 2.44 | 0.267 |
| 5.96 | 57 | 35 | 9.02 | 12.46 | 1.99 | 0.308 |

Figure 7:
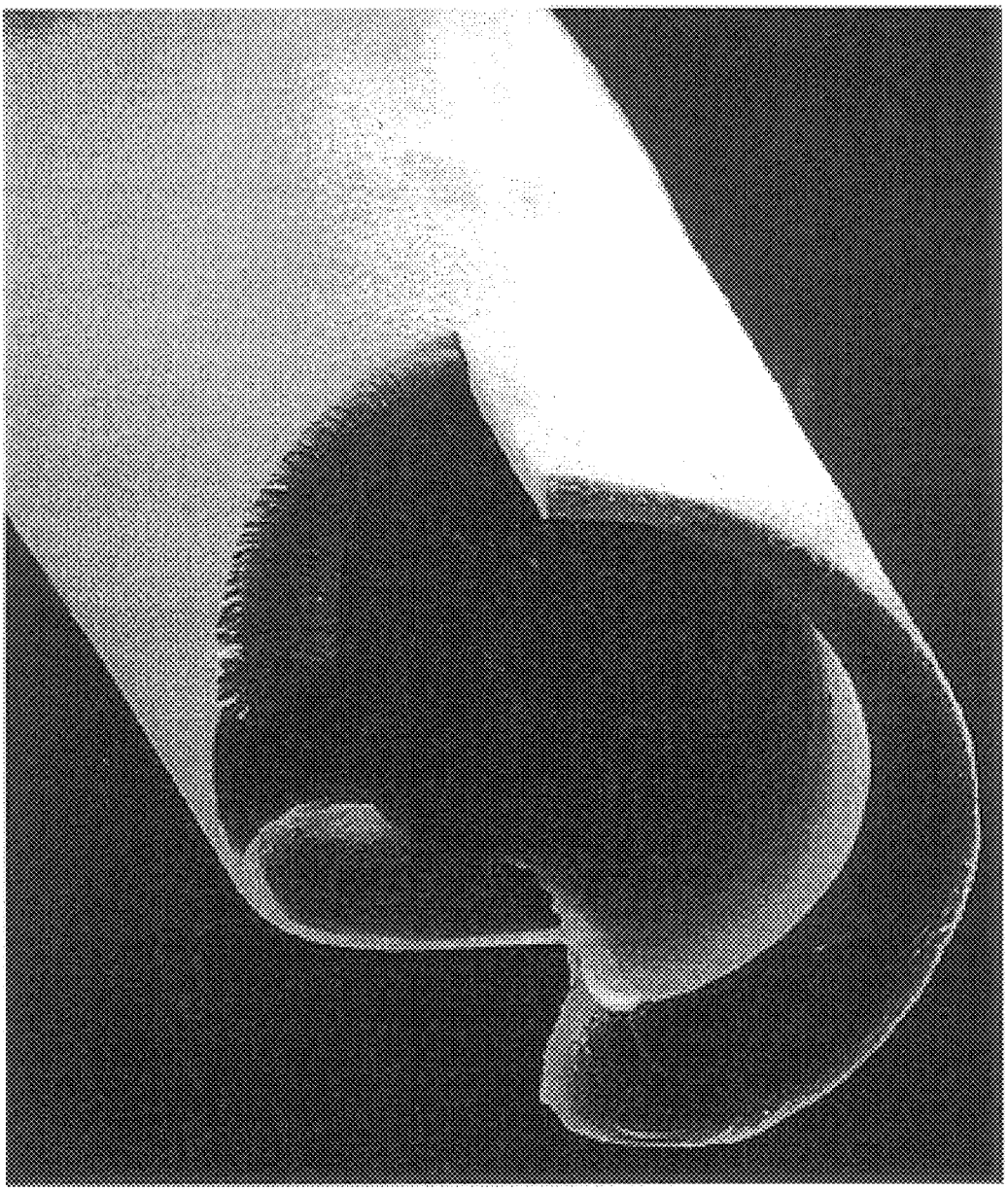
FIG. 7 is a scanning electron photomicrograph showing a hollow carbon fibre produced from a hollow polyacrylonitrile precursor

The conversion of hollow polyacrylonitrile precursor to hollow carbon fibre is achieved via the usual three stage process of oxidation, carbonisation and graphitization which is used for solid carbon fibres and which will be familiar to those skilled in the art. The fibres are heated in an oxygen containing atmosphere between 200° and 300° C. whilst under tension so as to prevent shrinkage and even cause extension. The chemistry of the process is very complex and will be familiar to some of those skilled in the art. Two important processes are the reaction of nitrile groups to form ring structures and promotion of cross-linking by oxygen. The former is particularly exothermic and must be performed at a controlled rate. This may be achieved through a variety of methods, for example passing through a series of four ovens with progressively increasing temperatures in the temperature range specified. Oxidation stabilises the fibres for the subsequent carbonisation step. Carbonisation is carried out in an inert atmosphere, typically nitrogen, at approximately 1000° C. for commercial processes to remove non-carbon elements as volatiles; a non-exclusive list includes $H_2O$, HCN, $NH_3$, CO, $CO_2$ and $N_2$. The rate of heating in the early stages is generally low so that the release of volatiles does not damage the fibre. This may typically be achieved by passing the fibre through a furnace with a gradual temperature gradient from above 350° C. to 700°–1000° C. The resultant carbon fibre has lost most of its non-carbon impurities. Further heat treatment at temperatures in the range 1300°–3000° C. can improve mechanical properties; Young's modulus is clearly related to the final heat treatment temperature of graphitization. Further changes in processing, for example the application of tension during carbonisation and graphitization can effect mechanical properties. An example of a resultant hollow carbon fibre is shown in FIG. 7.

What is claimed is:

1. A solid-walled hollow carbon fiber produced from a hollow polyacrylonitrile fiber precursor, the precursor polyacrylonitrile fiber comprising a central lumen and a wall having a highly oriented interior surface facing the central lumen, a highly oriented exterior surface facing away from the central lumen and a homogenous, dense gel structure between the interior surface and the exterior surface, wherein the entire hollow polyacrylonitrile fiber is free of macrovoids.

2. A solid-walled hollow pyrolized carbon fiber produced from a hollow polyacrylonitrile fiber precursor, the precursor polyacrylonitrile fiber comprising a central lumen and a wall having a highly oriented interior surface facing the central lumen, a highly oriented exterior surface facing away from the central lumen and a homogenous, dense gel structure between the interior surface and the exterior surface, wherein the entire hollow polyacrylonitrile fiber is free of macrovoids.

3. A carbon fiber in accordance with claim 1 or 2 having a diameter of 20 to 40 μm.

4. A carbon fiber in accordance with claim 1 or 2 having a diameter of about 25 μm.

5. A carbon fiber in accordance with claim 1 or 2 wherein the polyacrylnitrile precursor comprises a copolymer of acrylonitrile with itatonic acid.

6. A solid-walled hollow carbon fiber produced from a hollow polyacrylonitrile fiber precursor comprising a central lumen and a wall having a highly oriented interior surface facing the central lumen, a highly oriented exterior surface facing away from the central lumen and a homogenous, dense gel structure between the interior surface and the exterior surface, wherein the entire hollow polyacrylonitrile fiber is free of macrovoids, said solid-walled hollow fiber produced by the process of:

(a) dissolving acrylic polymer in a solvent to form a dope;

(b) extruding the dope through an aperture in a spinneret to form a jet of liquid;

(c) injecting a first coagulant into the center of the liquid jet as it leaves the spinneret;

(d) directing the jet through an air gap into a coagulant bath containing a second coagulant to form a fiber;

(e) directing the thus formed fiber through a drawing bath to reduce the fiber's diameter; and (f) oxidizing, carbonizing then graphitizinge the polyacrylonitrile precursor fiber.

* * * * *